US011835065B2

(12) United States Patent
Lai et al.

(10) Patent No.: US 11,835,065 B2
(45) Date of Patent: Dec. 5, 2023

(54) FAN FRAME TURBULENCE STRUCTURE

(71) Applicant: ASIA VITAL COMPONENTS (CHINA) CO., LTD., Taipei (TW)

(72) Inventors: Hua Lai, Shenzhen (CN); Ze-Hua Tan, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 0 days.

(21) Appl. No.: 18/058,741

(22) Filed: Nov. 24, 2022

(65) Prior Publication Data

US 2023/0323897 A1 Oct. 12, 2023

(30) Foreign Application Priority Data

Apr. 7, 2022 (TW) ..... 111113269

(51) Int. Cl.
*F04D 29/66* (2006.01)
*F04D 29/52* (2006.01)
*F04D 19/00* (2006.01)

(52) U.S. Cl.
CPC ..... *F04D 29/663* (2013.01); *F04D 19/002* (2013.01); *F04D 29/522* (2013.01)

(58) Field of Classification Search
CPC ..... F04D 29/663; F04D 19/002; F04D 29/522
See application file for complete search history.

(56) References Cited

U.S. PATENT DOCUMENTS

2023/0032483 A1* 2/2023 Loercher ..... F04D 19/002

FOREIGN PATENT DOCUMENTS

| | | |
|---|---|---|
| TW | 201219661 A | 5/2012 |
| TW | M630341 U | 8/2022 |
| WO | 2020/173372 A1 | 9/2020 |

OTHER PUBLICATIONS

Search Report dated Oct. 3, 2022 issued by Taiwan Intellectual Property Office for counterpart application No. 11113269.

* cited by examiner

*Primary Examiner* — Aaron R Eastman
(74) *Attorney, Agent, or Firm* — Demian K. Jackson; Jackson IPG PLLC

(57) ABSTRACT

A fan frame turbulence structure includes a frame body having a wind incoming side and a wind outgoing side respectively on two sides of the frame body. The frame body defines an airflow passage which passes through the frame body from the wind incoming side to the wind outgoing side. The wind incoming side has an inlet in communication with the airflow passage. The inlet has a breaking section between the wind incoming side and the passage inner wall. The breaking section includes densely distributed breaking units. The breaking units define therebetween gaps in communication with the airflow passage. The breaking units serve to break and fracture airflow sucked in from the wind incoming side, whereby part of the airflow passes through the gaps between the breaking units and is broken and fractured into multiple gap turbulences to flow into the air passage so as to lower the wideband noise.

7 Claims, 2 Drawing Sheets

FAN FRAME TURBULENCE STRUCTURE

This application claims the priority benefit of Taiwan patent application number 111113269 filed on Apr. 7, 2022.

BACKGROUND OF THE INVENTION

1. Field of the Invention

The present invention relates generally to a fan frame, and more particularly to a fan frame turbulence structure.

2. Description of the Related Art

Along with the promotion of execution efficiency of electronic components, the heat dissipation requirement is abruptly increased.

Therefore, the active heat dissipation device (such as a fan) is applied to the electronic components in cooperation with the passive heat dissipation device. However, in order to lower the high temperature of the electronic components, the rotational speed of the fan is increased so that the noise made in operation of the fan becomes louder and louder. Therefore, it is critical how to lower the noise made by the active heat dissipation device. The active heat dissipation device such as an axial-flow fan includes a fan frame and a fan impeller pivotally disposed in the fan frame. The fan impeller has multiple blades. The fan frame has a wind incoming side and a wind outgoing side respectively positioned on two sides of the fan frame. In operation and working of the axial-flow fan, the higher the rotational speed is, the louder the noise is.

The noise made by the axial-flow fan can be basically classified into wideband noise and narrowband noise. With respect to wideband noise, there are two affection factors. The first factor is the noise caused by the vortexes produced at the tail ends of the blades. The second factor is the noise caused by the great airflow turbulence produced by a mess of airflow sucked in from the wind incoming side. Currently, the main stream in this field has two methods for solving the wideband noise. One is to reduce the gap between the tail ends of the blades of the fan impeller and the opposite inner side of the fan frame. The other is to install a rectifying device (such as a waveguide plate) on the wind incoming side of the fan frame. In the above two methods, the first one of reducing the gap between the tail ends of the blades of the fan impeller and the opposite inner side of the fan frame achieves better effect. However, in practical manufacturing of the fan according to such method, it is necessary strictly control the tolerance of the size of the blades so that the manufacturing precision is higher. This leads to increase of cost. Moreover, after the gap between the tail ends of the blades and the opposite inner side of the fan frame is reduced, the fan impeller is apt to clog due to alien article. As a result, the fan impeller may fail to normally rotate and be burnt down.

It is therefore tried by the applicant to provide a fan frame turbulence structure to solve the above problems existing in the conventional fan.

SUMMARY OF THE INVENTION

It is therefore a primary object of the present invention to provide a fan frame turbulence structure, which can break and fracture a mess of airflow sucked in from the wind incoming side of the fan frame into multiple fine gap turbulences to reduce the vortexes produced at the tail ends of the blades so as to effectively lower the noise.

To achieve the above and other objects, the fan frame turbulence structure of the present invention includes a frame body having a wind incoming side and a wind outgoing side, which are respectively disposed on two sides of the frame body. The frame body defines an airflow passage therein. The airflow passage passes through the frame body from the wind incoming side to the wind outgoing side. The airflow passage has a passage inner wall connected with the wind incoming side and the wind outgoing side. The wind incoming side has an inlet in communication with the airflow passage. The inlet has a breaking section positioned between the wind incoming side and the passage inner wall. The breaking section includes multiple densely distributed breaking units. The breaking units define therebetween multiple gaps in communication with the airflow passage.

The breaking units of the breaking section of the present invention serve to break and fracture airflow sucked in from the wind incoming side, whereby part of the airflow passes through the gaps between the breaking units and is broken and fractured into multiple gap turbulences to flow into the air passage. Therefore, the breaking units can break and fracture a mess of airflow sucked in from the wind incoming side so as to achieve lowering effect for the wideband noise. In addition, the fan frame turbulence structure of the present invention is pivotally assembled with a fan impeller to form a fan, whereby the vortexes produced at the tail ends of the fan blades are reduced so as to effectively lower the noise caused by the vortexes.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
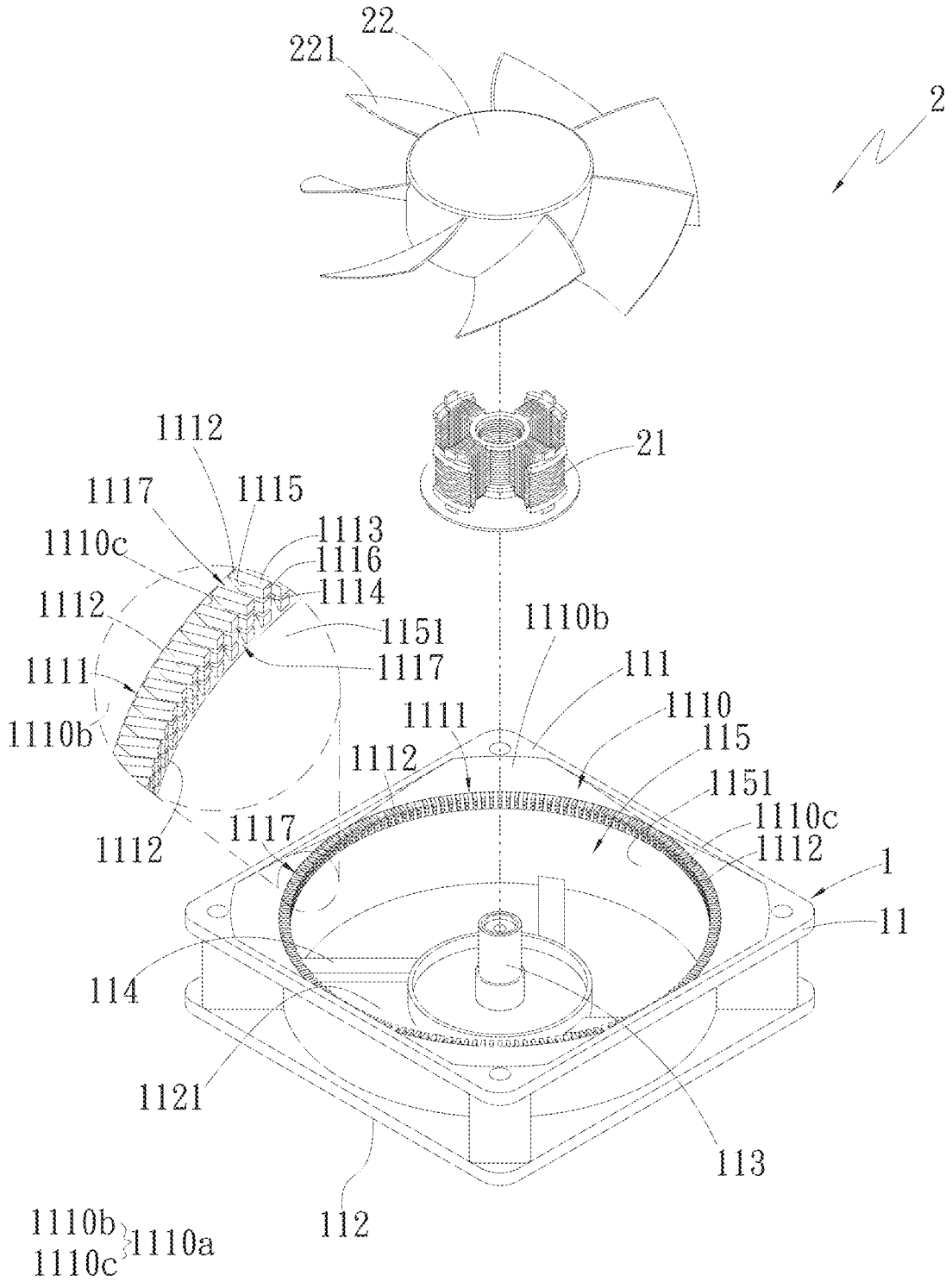
FIG. 1 is a perspective exploded view of the present invention.

Please refer to FIG. 1. The fan frame turbulence structure 1 of the present invention includes a frame body 11. In this embodiment, the frame body 11 is one single fan frame (such as axial-flow fan frame). Alternatively, the frame body 11 can be a series fan frame. Two sides of the frame body 11 are respectively a wind incoming side 111 and a wind outgoing side 112. The frame body 11 defines an airflow passage 115 therein. The airflow passage 115 passes through the frame body 11 from the wind incoming side 111 to the wind outgoing side 112. The airflow passage 115 has a passage inner wall 1151 respectively connected with the wind incoming side 111 and the wind outgoing side 112.

Please further refer to FIG. 1. The wind incoming side 111 has an inlet 1110, while the wind outgoing side 112 has an outlet 1121. The inlet 1110 and the outlet 1121 communicate with the airflow passage 115. A bearing cup 113 is disposed at a center of the outlet 1121. The bearing cup 113 is connected with the passage inner wall 1151 of the frame body 11 via multiple support sections 114 (such as ribs or static blades). The inlet 1110 has a wind incoming face 1110*a* and a breaking section 1111 respectively positioned between the wind incoming side 111 and the passage inner wall 1151. The wind incoming face 1110*a* has a wind guide surface 1110*b* and an arrangement surface 1110*c* positioned between the passage inner wall 1151 and the wind guide surface 1110*b*. The wind guide surface 1110*b* is an inclined surface or a vertical surface. The arrangement surface 1110*c* in inclined from or normal to the corresponding outlet 1121.

The breaking section 1111 is disposed on the arrangement surface 1110*c* and includes multiple densely or sparsely distributed breaking units 1112. The breaking units 1112 are integrally formed or non-integrally formed on the arrangement surface 1110*c*. In addition, the breaking units 1112 can be selectively side by side densely arranged on the arrangement surface 1110*c* in single row or side by side densely arranged on the arrangement surface 1110*c* in multiple rows. Each two adjacent breaking units 1112 define therebetween a gap 1117. The size of the breaking unit 1112 is such as, but not limited to, preferably smaller than or equal to 1 mm. Also, the width of the gap 1117 defined between the breaking units 1112 is such as, but not limited to, smaller than or equal to 1 mm. Accordingly, at least or more than 25 blocks (columns) of breaking units 1112 per unit area of square centimeter are side by side densely arranged on the breaking section 1111 in single row or side by side densely arranged on the breaking section 1111 in multiple rows.

In addition, in this embodiment, the breaking units 1112 of the breaking section 1111 are, but not limited to, in the form of rectangular prism body. By means of mechanical processing (such as cutting), the breaking units 1112 are, but not limited to, side by side densely formed on the arrangement surface 1110*c* of the wind incoming side 111 at intervals in multiple rows. In a modified embodiment, the breaking units 1112 are selectively in the form of equilateral or non-equilateral polygonal prism body (such as triangular prism body or rectangular prism body), semispherical body, regularly shaped body (such as X-shaped body or substantially E-shaped body) or irregularly shaped body (such as grain body). The breaking units 1112 are connected on the arrangement surface 1110*c* by means of insertion, adhesion or hook and loop fasteners.

Each of the aforesaid rows includes multiple breaking units 1112 positioned on the same level. The breaking unit 1112 has an upper side 1113 and a lower side 1114, which are flush with the upper side 1113 and the lower side 1114 of an adjacent breaking unit 1112. That is, the upper row of breaking units 1112 are, but not limited to, arranged on the same level, while the lower row of breaking units 1112 are, but not limited to, arranged on the same level. Alternatively, the upper and lower sides 1113, 1114 of the breaking unit 1112 in each row are not flush with the upper and lower sides 1113, 1114 of the adjacent breaking unit 1112. That is, the upper and lower sides 1113, 1114 of the breaking unit 1112 are not positioned on the same level as the upper and lower sides 1113, 1114 of the adjacent breaking unit 1112 and staggered from the upper and lower sides 1113, 1114 of the adjacent breaking unit 1112.

Moreover, two lateral walls 1115 and an outward protruding side 1116 are respectively connected between the upper and lower sides 1113, 1114 of each breaking unit 1112. The outward protruding side 1116 faces the airflow passage 115 and is, but not limited to, axially flush with the passage inner wall 1151 without exceeding the passage inner wall 1151. Alternatively, the length (or height) of the breaking units 1112 in one row is different from the length (or height) of the breaking units 1112 in another row. For example, the length of the breaking units 1112 is gradually increased from the upper row to the lower row or from the lower row to the upper row. In this case, the outward protruding sides 1116 of the breaking units 1112 in the upper and lower rows are not axially flush with each other.

The gap 1117 is defined between the opposite lateral walls 1115 of each two adjacent breaking units 1112 in each row. The gaps 1117 are in communication with the airflow passage 115. In this embodiment, the gaps 1117 are equal to each other (as shown in FIG. 1). However, in another embodiment, the gaps 1117 between the breaking units 1112 are unequal to each other. Accordingly, when airflow is sucked in from the wind guide surface 1110*b* of the wind incoming side 111 of the frame body 11, part of the airflow will impact the breaking units 1112 on the breaking section 1111 and be broken and fractured. When passing through the gaps 1117, the part of the airflow is broken and fractured into multiple fine gap turbulences to flow into the air passage 115. Such fine gap turbulences have little airflow turbulence so that the noise is lowered. Accordingly, the problem that a mess of airflow is sucked into the wind incoming side 111 to produce great airflow turbulences and make wideband noise is effectively solved.

Figure 2:
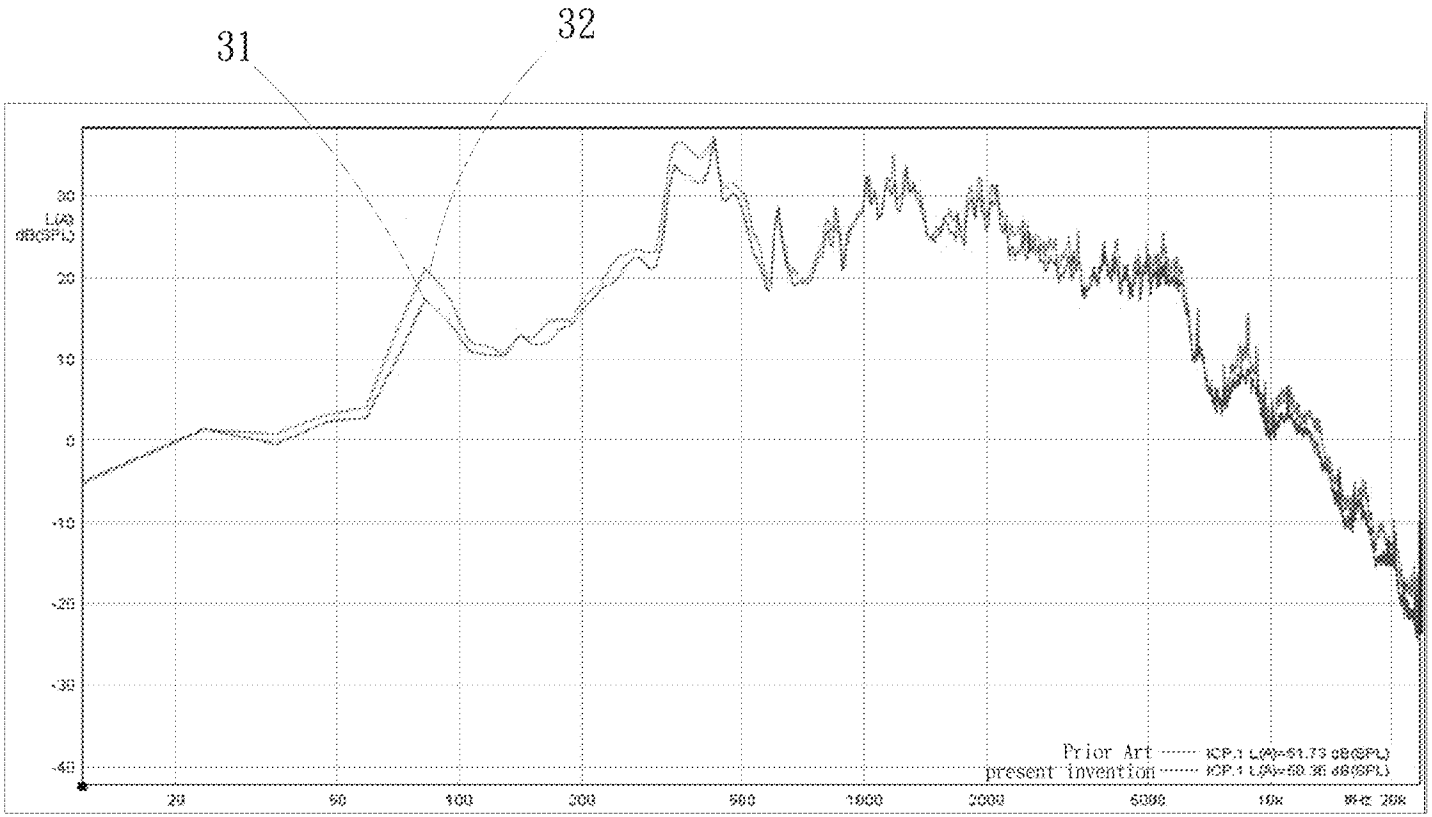
FIG. 2 is a frequency spectrum comparison diagram of fan broadband noise between the present invention and the conventional fan.

Please further refer to FIG. 1. A stator assembly 21 is fitted around the bearing cup 113 of the frame body 11. A fan impeller 22 with multiple blades 221 is received in the airflow passage 115 and pivotally disposed on the bearing cup 113. The frame body 11, the stator assembly 21 and the fan impeller 22 together form a fan 2 (such as an axial-flow fan). When the fan impeller 22 of the fan 2 rotates to suck airflow, part of the airflow sucked in from the wind incoming side 111 of the frame body 11 is broken and fractured by the breaking units 1112. When passing through the gaps 1117, the part of the airflow is broken and fractured into the gap turbulences to flow into the air passage 115. Accordingly, the airflow passing through the gap between the tail ends of the blades 221 of the fan impeller 22 and the passage inner wall 1151 has little airflow turbulence so that the vortexes produced at the tail ends of the blades 221 is reduced and the wideband noise caused by the vortexes is reduced (lowered). The gap turbulences flowing into the air passage 115 are pressurized by the blades 221 of the fan impeller 22 and then flow out from the outlet 1121 of the wind outgoing side 112. Please refer to FIG. 2, which is a frequency spectrum comparison diagram of fan broadband noise between the present invention and the conventional fan. The longitudinal axis represents sound pressure level (SPL) with a unit of dB (SPL). The transverse axis represents frequency (f) with a unit of Hz. As shown in the drawing, the curve 31 (red curve) of the present invention is lower than the curve 32 (green curve) of the conventional fan. Moreover, the fan wideband noise of the present invention is 50.36 dB (SPL), while the fan wideband noise of the conventional fan is 51.73 dB (SPL). Apparently, the fan wideband noise of the present invention is lower than the fan wideband noise of the conventional fan. Therefore, in comparison with the conventional fan, the present invention effectively lowers the fan wideband noise.

In the above embodiments, the frame body 11 is, but not limited to, a one-piece fan frame. In a modified embodiment, the frame body 11 includes an upper frame section and a lower frame section. The upper and lower frame sections are serially connected with each other to form the frame body. Alternatively, the frame body 11 solely serves as an upper frame section disposed on the wind incoming side of another fan frame (such as axial-flow fan frame) as a device of the wind incoming side.

Accordingly, in the present invention, numerous breaking units 1112 are densely arranged on the wind incoming side 111 to improve the problem that a mess of airflow is sucked into the wind incoming side 111 and lower the noise caused by the vortexes produced at the tail ends of the blades 221. Therefore, the wideband noise is effectively lowered and the manufacturing process is simplified.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan frame turbulence structure comprising a frame body having an incoming side and an outgoing side respectively disposed on two opposite sides of the frame body, the frame body defining an airflow passage passing through the frame body from the incoming side to the outgoing side, the airflow passage having a passage inner wall connected with the incoming side and with the outgoing side, the incoming side having an inlet and the outgoing side having an outlet, both the inlet and outlet in communication with the airflow passage, the inlet having a guide surface and an arrangement surface, wherein the arrangement surface is positioned between the passage inner wall and the guide surface, and wherein the arrangement surface is inclined from the outlet to form an inclined surface and having a breaking section positioned on the arrangement surface, the breaking section including multiple distributed breaking units, the breaking units defining therebetween multiple gaps in communication with the airflow passage, the breaking units serving to disrupt airflow sucked in from the incoming side, whereby part of the airflow passes through the gaps between the breaking units and is broken into multiple gap turbulences to flow into the air passage.

2. The fan frame turbulence structure as claimed in claim 1, wherein each breaking unit has an upper side and a lower side, the upper sides of the breaking units being flush with each other and the lower sides of the breaking units being flush with each other.

3. The fan frame turbulence structure as claimed in claim 1, wherein the breaking units are side by side arranged on the breaking section in multiple rows.

4. The fan frame turbulence structure as claimed in claim 3, wherein the breaking units are integrally formed on the breaking section.

5. The fan frame turbulence structure as claimed in claim 1, wherein the breaking units are connected on the breaking section by means of mechanical processing.

6. The fan frame turbulence structure as claimed in claim 1, wherein the frame body is a one-piece fan frame.

7. The fan frame turbulence structure as claimed in claim 1, wherein the breaking units are in the form of a polygonal prism body.

* * * * *